United States Patent [19]

Miller

[11] 4,295,673

[45] Oct. 20, 1981

[54] VERTICAL ROD EXIT DEVICE

[75] Inventor: Theodore H. Miller, New Britain, Conn.

[73] Assignee: Emhart Industries, Inc., Farmington, Conn.

[21] Appl. No.: 82,538

[22] Filed: Oct. 9, 1979

[51] Int. Cl.[3] ..... E05C 9/04; E05C 15/02

[52] U.S. Cl. ..... 292/21; 49/141; 49/395; 292/336.3

[58] Field of Search ..... 49/141, 394, 395; 292/21, 92, 336.3

[56] References Cited

U.S. PATENT DOCUMENTS

| | | | |
|---|---|---|---|
| 919,269 | 4/1909 | Voight | 292/21 |
| 1,014,960 | 1/1912 | Ericson | 292/21 |
| 1,069,075 | 7/1913 | Voight | 292/21 |
| 3,083,560 | 4/1963 | Scott | 292/21 X |
| 3,228,069 | 1/1966 | Frueh | 292/92 X |
| 3,583,740 | 8/1968 | Armstrong | 292/21 X |
| 3,765,198 | 10/1973 | Horgan, Jr. . | |
| 3,819,213 | 6/1974 | Vanderburgh | 292/21 |
| 3,877,262 | 4/1975 | Williams | 292/92 X |

*Primary Examiner*—Philip C. Kannan

*Attorney, Agent, or Firm*—McCormick, Paulding & Huber

[57] ABSTRACT

An emergency exit device mounted on the inner face of an outwardly opening door includes top and bottom latches mounted near the beveled or free side edge of the door and connected to an operating unit by vertically extending rods. The operating unit is at all times operable to release the latches in response to pressure applied in a door opening direction to a push bar which extends across the inner face. The latches are released from the outer side of the door by a rotary operator operably connected to the operating unit and having a conventional backset. The vertical axis of the rods is horizontally offset from the axis of the rotary operator in the direction of the free side edge of the door.

16 Claims, 9 Drawing Figures

VERTICAL ROD EXIT DEVICE

BACKGROUND OF THE INVENTION

This invention relates in general to emergency exit devices and deals more particularly with an improved exit device of the vertical rod type which includes at least one latch unit connected to an operating unit by a vertically extending rod. It is generally desirable that the latch unit, and consequently the vertical rod which operates it, be located near the beveled or free side edge of the door. In most, if not all, exit devices of the aforedescribed type the position of the latch or latches and operating rod or rods on the door determines the position of any outside operator which may be provided. However, when such a device is installed on a prefabricated door which is prebored to receive an outside operator which has a conventional backset the position of the bore will be the determining factor in locating each latch and its associated operating rod relative to the free side edge of the door. Thus, optimum positioning of a latch or pair of latches may not be obtainable on such an installation.

It is the general aim of the present invention to provide an improved vertical rod exit device particularly adapted for installation on a prefabricated door which includes a preformed transverse opening or bore therethrough which has a conventional backset, that is the axis of the bore is set back or horizontally offset a conventional distance from the beveled edge of the door, as, for example, 2⅝ or 2¾ inches. It is a further aim of the invention to provide an improved exit device of the aforedescribed type particularly adapted to utilize a low profile push bar.

In accordance with the present invention there is provided a vertical rod emergency exit device for mounting on the inner face of an outwardly opening door to secure the door in closed position. The device has at least one vertically extending latch operating rod, an operating unit or rod shifting mechanism operably connected to the latch operating rod, an outside operator operably connected to the rod shifting mechanism, and an inside actuator engaged with the rod shifting mechanism and operable at all times in response to pressure applied in a door opening direction to move said latch operating rod to latch releasing position whereby to release the door. The outside operator comprises a rotary member supported on the door for angular movement about a horizontal axis, horizontally spaced from the vertically extending latch operating rod, and operable to move the operating rod to latch releasing position.

DETAILED DESCRIPTION OF PREFERRED EMBODIMENT

Figure 1:
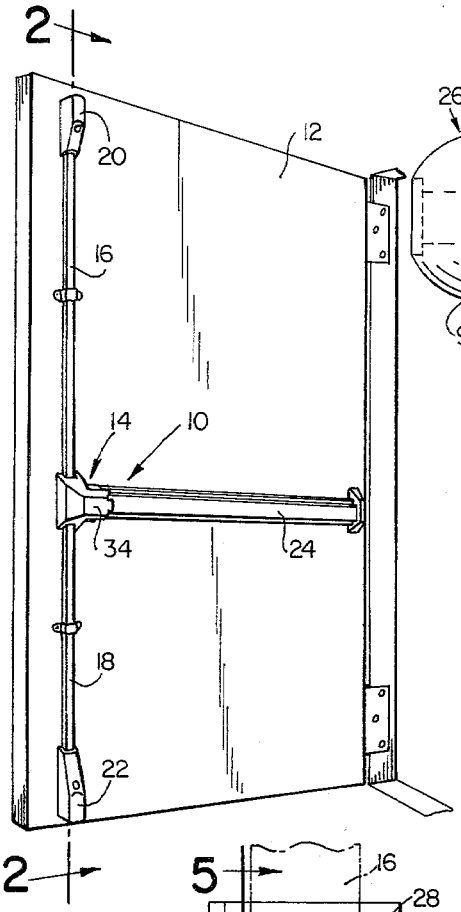
FIG. 1 is a perspective view of a vertical rod exit device embodying the invention and shown mounted on the inner face of an outwardly opening door.
Figure 2:
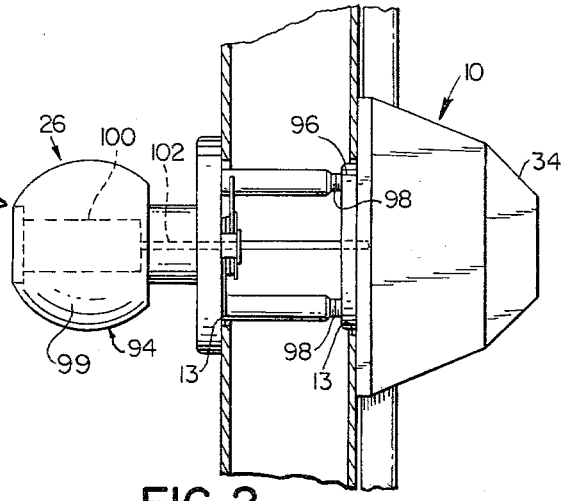
FIG. 2 is a somewhat enlarged fragmentary sectional view through the door taken along the line 2—2 of FIG. 1 and shows the outside operator or knob assembly.

Referring now to the drawings, a vertical rod exit device embodying the present invention and indicated generally by the reference numeral 10 in FIG. 1 is shown mounted on the inner face of an outwardly opening door. The illustrated device 10 is particularly adapted for mounting on a prefabricated door which has a preformed transverse opening to accommodate a rotary operator mounted on the door. In the drawings the exit device 10 is shown moiunted on a hollow metal door 12 which has circular bores 13, 13 opening through its inner and outer faces, as best shown in FIG. 2.

The exit device of the present invention essentially comprises a rod shifting mechanism and at least one vertically extending latch operating rod. However, the illustrated exit device 10 has an upper operating rod 16 and a lower operating rod 18. Each operating rod is connected at one end to a latch rod shifting mechanism, indicated generally at 14, and at its other end to an associated latch unit. As shown in FIG. 1, the upper rod 16 is connected to a top latch unit 20 whereas the lower rod 18 is connected to a bottom latch unit indicated generally by the numeral 22.

The exit device 10 is at all times operable to release the latches 20 and 22 in response to pressure applied in a door opening direction to a push bar or crossbar 24 mounted on the inner surface of the door and operably connected to the rod shifting mechanism 14. The illustrated exit device further includes an outside operating assembly indicated generally at 26 in FIG. 2. The operating assembly 26 is operably connected to the rod shifting mechanism 14 and is operable to shift the rods 16 and 18 to latch releasing position, as will hereinafter be more fully described.

Various latch units may be used in practicing the invention. When the exit device is provided with two latch units, as illustrated, it is only essential that both latch units be releasable upon movement of their respective latch releasing rods in one vertical direction. A typical top latch unit which may be used is illustrated and described in U.S. Pat. No. 3,776,582 to Balducci for Latch Assembly, issued Dec. 4, 1973 and assigned to the assignee of the present application. A typical bottom latch unit suitable for use in practicing the invention is shown and described in U.S. Pat. No. 3,563,585 to Welch for A Latch Unit for a Door Lock, issued Feb. 16, 1971 and also assigned to the assignee of the present invention. The rod shifting mechanism 14, hereinafter more fully described, is particularly adapted to be operated by a low profile actuator assembly or push bar such as illustrated and described in U.S. Pat. No. 3,877,262 to Williams for Emergency Exit Latch and Actuator Assembly, issued Apr. 15, 1975 and assigned to the assignee of the present invention.

The top and bottom latch units and the inside actuator assembly need not be considered, in detail, to enable complete understanding of the invention and will not be hereinafter described in detail, however, for further details as to these mechanisms reference may be had to the aforeidentified patents which are hereby adopted by reference as part of the present disclosure.

Figure 3:
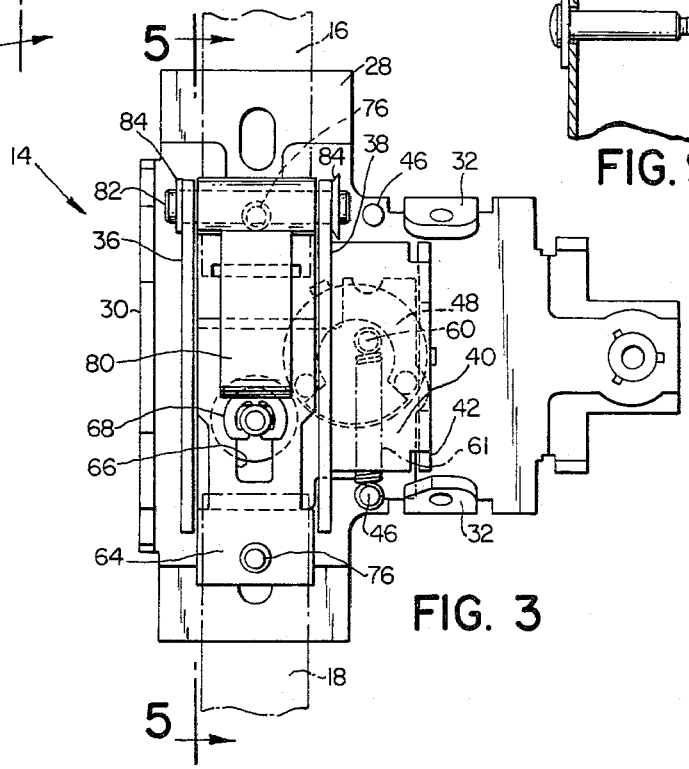
FIG. 3 is a somewhat enlarged fragmentary elevational view and shows the rod shifting mechanism with the cover removed therefrom.
Figure 4:
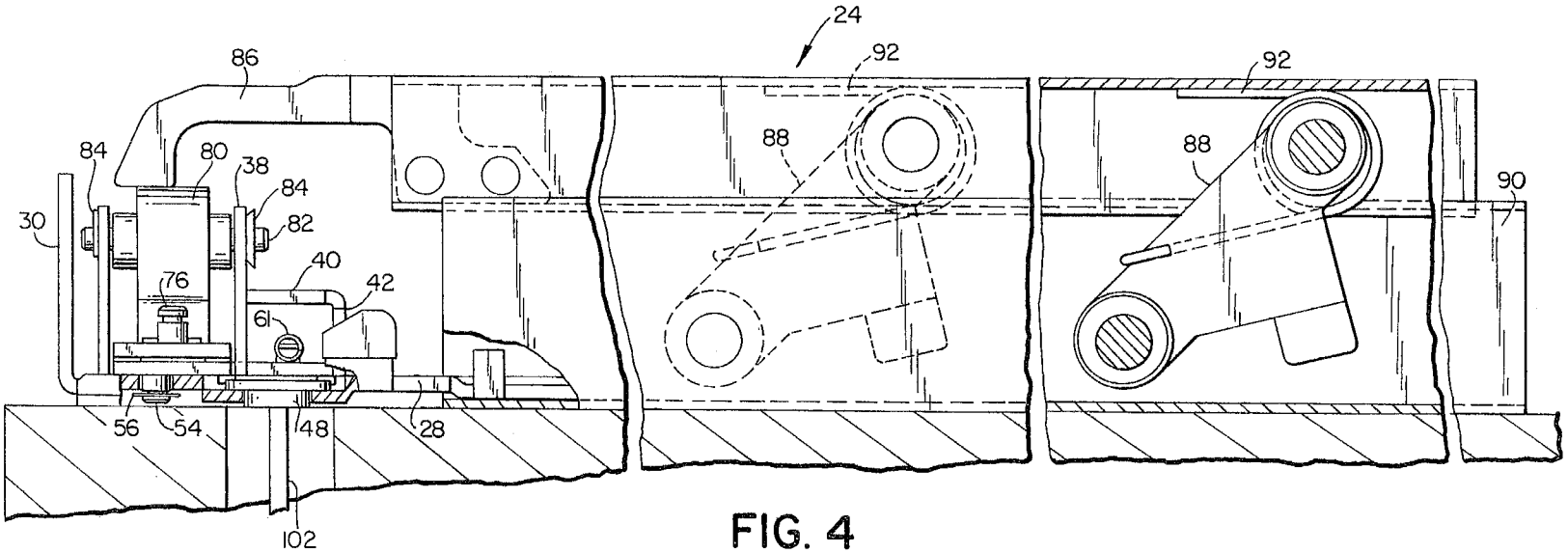
FIG. 4 is a somewhat enlarged fragmentary bottom view of the exit device of FIG. 1 shown partially in section and with its cover removed.
Figure 5:
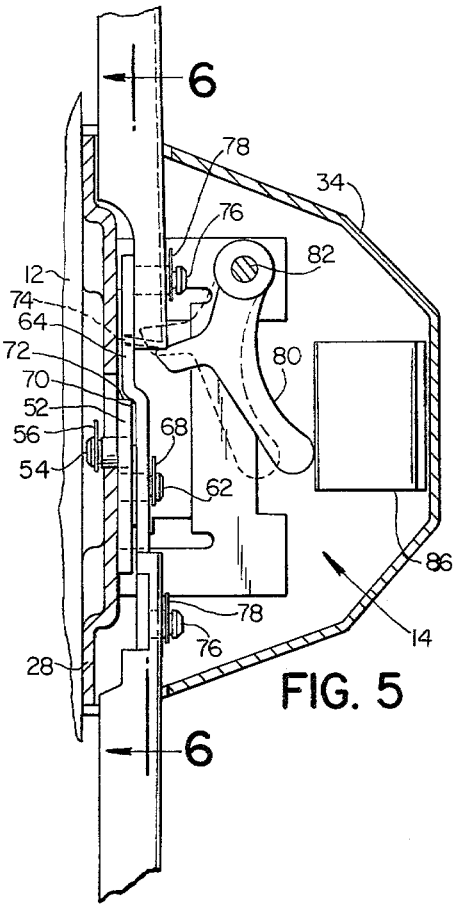
FIG. 5 is a fragmentary elevational view taken along the line 5—5 of FIG. 3.
Figure 6:
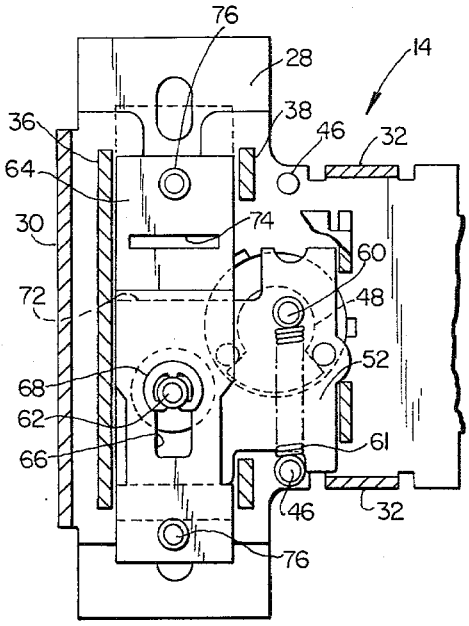
FIG. 6 is a sectional view taken along the line 6—6 of FIG. 5.
Figure 7:
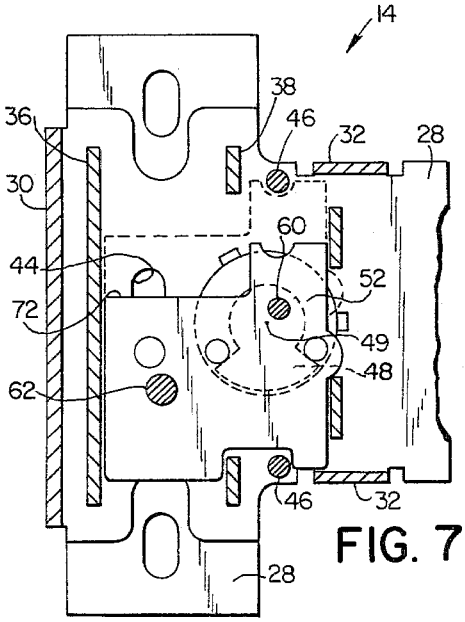
FIG. 7 is similar to FIG. 5, but shows the rod shifting mechanism with the rod connector removed therefrom to reveal the structure therebehind.
Figure 8:
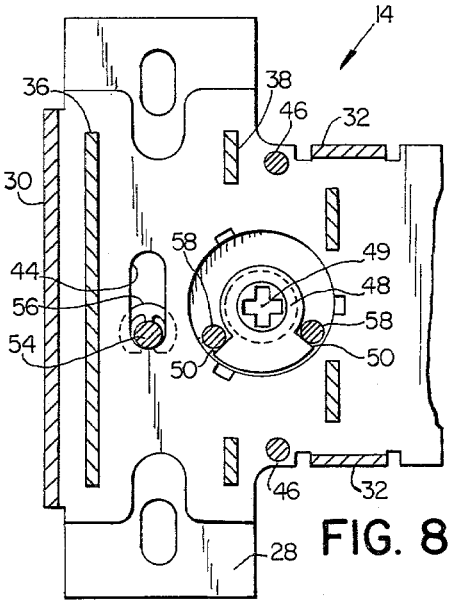
FIG. 8 is similar to FIG. 7 but shows the rod shifting mechanism with the slide removed to reveal the structure therebehind.

Considering now the exit device 10 in further detail and referring particularly to FIGS. 3–8, the rod shifting mechanism 14 comprises a frame assembly which includes a generally T-shaped back plate 28 adapted to be mounted on the inner face of a door, such as the door 12, and near the beveled edge of the door. The T-shaped back plate 28 is mounted on the door 12 with the normally vertically extending leg of the T horizontally oriented, substantially as shown. Slots at the opposite ends of the head of the "T" receive fasteners which secure the base plate 28 to the door inner surface. The plate 28 has a formed central portion spaced away from the door surface to provide clearance between the rear surface of the plate and the door surface, as shown in FIG. 5. The back plate 28 has an inwardly bent portion at one end which defines a generally vertically disposed forward wall 30. A pair of opposing tabs 32, 32 are bent inwardly from the back plate and toward each other, as shown in FIG. 3, to retain a housing or cover 34, shown in FIGS. 1, 2 and 5. A pair of horizontally spaced apart and vertically disposed frame plates 36 and 38, staked or otherwise fastened to the back plate 28, project inwardly from the back plate in generally parallel relation. A portion of the frame plate 38, indicated at 40, is bent to extend from the main portion of the latter plate in parallel spaced relation to the horizontal leg of the back plate 28 and has an outwardly bent portion 42 which is horizontally spaced from the main portion and staked or otherwise secured to the back plate as best shown in FIG. 4. A vertically disposed slot 44 is formed in the central portion of the back plate 28 between the frame plates 36 and 38, as best shown in FIG. 8. A pair of vertically spaced apart spring retaining pins 46, 46 are staked or otherwise secured to the back plate 28 and project inwardly therefrom as best shown in FIGS. 7 and 8. The terminal end of the back plate leg is shaped to be engaged with and fastened to the frame of an associated inside actuator assembly, such as the one shown in the aforementioned U.S. patent to Williams, and as shown in FIG. 4.

It should be noted that the frame assembly hereinbefore described is generally symmetrical about its horizontal axis. Thus, the frame assembly is non-handed and may be assembled with other parts of the rod shifting mechanism 14 for use on either a right or left handed door.

The latch rod shifting mechanism 14 further includes a rotary key center or cam 48 which is journaled on the back plate and within a recess in the latter plate. A central portion of the cam 48 is formed with an X or cruciform shaped aperture for receiving the tailpiece of a lock cylinder or the like. The key center has a pair of jadially disposed and angularly spaced apart cam surfaces 50, 50, best shown in FIG. 8.

A key plate or key slide 52 is mounted on the base plate 28 between the frame plates 36 and 38 for vertical sliding movement on the frame assembly. A retaining pin 54 staked or otherwise secured to the key slide 52 extends rearwardly through the slot 44 and receives a retaining ring 56, as best shown in FIG. 8. The pin 54 and retaining ring 56 secure the key slide to the frame assembly for vertical sliding movement thereon. A pair of follower pins 58, 58 project from the rear of the key slide 52 and engage the cam surfaces 50, 50 on the key center 48, as best shown in FIG. 8. Another spring retaining pin 60 projects forwardly from the key slide 52 and receives a retaining spring 61 which acts between the pin 60 and the lower pin 46 to bias the key slide in a downward direction to its full line position of FIG. 7. Another retaining pin 62 projects from the front surface of the key slide 52 in horizontally offset relation to the axis of the key center 48, the latter axis being indicated at 49. The key slide 52 is handed, therefore a key slide of appropriate hand must be assembled with the frame assembly to adapt the rod shifting mechanism 14 for desired function.

A rod connector 64, best shown in FIG. 6, is positioned on the frame assembly in overlying relation with an associated portion of the key slide 52, as shown in FIGS. 5 and 6. A vertically extending slot 66 formed in the lower portion of the rod connector 64 receives the pin 62 therethrough. A retaining ring 68 snapped in engagement with the free end of the pin 62 retains the rod connector 64 in assembly with the key slide. The upper portion of the rod connector 64 is rearwardly offset from the lower portion, as best shown in FIG. 5, so that a generally horizontally disposed abutment surface 70 is formed for cooperating engagement with an associated abutment surface 72 formed on the key slide 52 and best shown in FIG. 7. A horizontally disposed slot 74 is formed in the upper portion of the rod connector 64, as best shown in FIG. 6. Rod connecting pins 76, 76 project forwardly from the upper and lower ends of the rod connector 64 to respectively receive the upper latch operating rod 16 and the latch operating lower rod 18. The rods 16 and 18 are retained on respectively associated pins 76, 76 by associated retaining rings 78, 78 as shown in FIG. 5. The upper rod 16 is formed with a rearwardly extending lip which is received within the slot 74, as best shown in FIG. 5.

Pressure applied to the inside actuator or push bar is transmitted to the rod shifting mechanism 14 by actuating member or lifting lever 80 which comprises a part of the latter mechanism. The lifting lever 80 is in the nature of a bell crank supported to pivot about a horizontal axis by a pivot pin 82 which is mounted on and extends between the frame plates 36 and 38. Retaining rings 84, 84 secured to opposite ends of the pin 82 retain the bell crank 80 in position on the frame assembly. One leg of the bell crank 80 is engaged with an abutment surface at the lower end of the rod 16, as best shown in FIG. 5. The other leg of the bell crank is engaged by an actuator 86 carried by the push bar and shown in FIGS. 4 and 5.

The push bar 24, as shown, comprises an horizontally elongated channel member and forms part of a parallelogram linkage which includes links 88, 88. The latter links are pivotally connected to the push bar 24 and to another channel member 90 which is fastened to the surface of the door 12. Springs 92, 92 associated with the links 88, 88 cooperate with the push bar to urge it in a direction away from the door. The actuator 86 is secured to one end of the push bar 24 and arranged to engage the bell crank 80.

The outside operating assembly 26, shown in FIG. 2, comprises a knob assembly 94 secured in fixed position adjacent the outer surface of the door 12 by a conventional mounting plate 96 and through bolts 98, 98. The knob assembly includes a knob 99 and a conventional key operated lock cylinder 100 which is mounted in a conventional manner in the knob. The key plug of the lock cylinder 100 is connected through a lost motion connection to a tailpiece 102 which is engaged in the drive slot of the key center 48. The illustrated knob assembly 94 is substantially identical to the knob assembly used in CORBIN Cylindrical Lock 5655 (Classroom function), manufactured and marketed by the assignee of the present invention.

When the door is secured in its closed position by the top and bottom latch units 20 and 22 and pressure is applied to the push bar 24 in a door opening direction, and the push bar 24 moves toward the door and is maintained in parallel relation to it by the links 88, 88. This movement of the push bar causes the actuator 86 carried by the push bar to exert pressure on an associated leg of the bell crank 80 causing it to rotate in a clockwise direction from its position of FIG. 5. The other leg of the bell crank 80 engages the abutment on the lower end of the rod 16 and exerts upward force upon the latter rod to lift it or move it towards its latch releasing position. The rod connector 64 which is attached to the rod 16, in turn, exerts an upward force on the lower rod 18 connected to it. The top and bottom latch units 20 and 22 are released by the upward movement of the rods 16 and 18, in a manner well known in the art. The illustrated upper latch unit 20 is of type which latches in its released position when the door 12 is opened. The upper latch unit, in turn, retains the rods 16 and 18 in raised position for as long as the door remains open.

It should be noted that the rod connector 64 is free to move with the rods 16 and 18 and relative to the key slide 52 due to the slot and pin connection 66 and 68 between the rod connector 64 and the pin slide 52. Thus the inside operating assembly or push bar 24 is operable at all times and independently of the outside operating assembly to release the latches which secure the door, thereby assuring egress under any and all emergency conditions.

The illustrated exit device may also be operated from the outside by a proper key or by the knob 99, when the lock cylinder 100 is in its unlocked condition. Insertion of the key (not shown) into the lock cylinder 100 and rotation of the key in one direction from its shed position unlocks the knob 99. The key may be returned to its shed position and withdrawn from the lock cylinder leaving the knob in unlocked position. Rotation of the knob in either direction causes corresponding rotation of the key center 48. One or the other of the cam surfaces 50, 50 engages and moves its associated pin 58 whereby the key slide 52 moves in a vertical direction against the biasing force of the spring 61. The exit device may also be operated by rotating the key in one direction past its knob unlocking position to apply direct driving force from the key through the tailpiece 102 to the key center 48.

When the rod 16 and 18 are in lowered or latching position the pin 62 carried by the key slide 52 is lodged within the upper end of the slot 66. The abutment surface 72 on the key slide is also in substantial engagement with the corresponding downwardly facing abutment surface 70 on the rod connector 64. Thus, upward movement of the key slide 52 causes a corresponding upward movement of the rod connector 64 which movement is transmitted to the upper and lower rods 16 and 18 by the rod connector. This movement occurs independently of any movement of the bell crank 80. Thus, rotation of the knob 99 in either direction or rotation of the proper key in one direction within the lock cylinder and to a position beyond its knob unlocking position causes release of the top and bottom latch units 20 and 22. As previously noted the vertical rods 16 and 18 will remain in released position for as long as the door remains open. However, the key slide 52 is free to return to its lower position under the urgency of the return spring 61 leaving the door in an open condition.

When the door is closed engagement of a part of the upper latch unit 20 with the door frame (or with an associated strike mounted on the frame) causes latching of the door. The door cannot be again opened until the latches are released by manipulation of the key from the outside or the exertion of outward pressure on the push bar.

Figure 9:
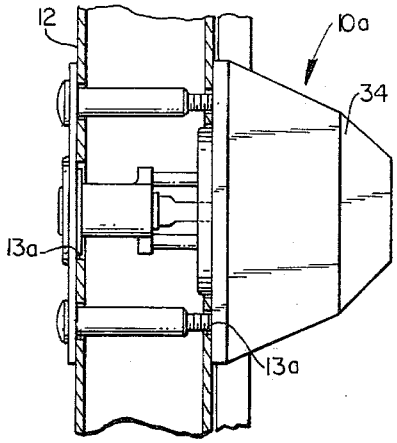
FIG. 9 is similar to FIG. 2, but shows another embodiment of the invention.

In FIG. 9 there is shown another embodiment of the invention, indicated generally at **10*a*, wherein the outside operator comprises a lock cylinder mounted on the outer face of a door 12*a* and within a prebored opening 13*a* in the door. The tailpiece of the lock cylinder indicated at 102*a* is engaged with the key center of a rod shifting mechanism such as the mechanism 14**, previously described so that the door maybe operated from the outside by manipulation of a key (not shown). A handle (not shown) maybe provided on the outer side of the door for pulling the door open when the latches have been released by operation of the lock cylinder.

I claim:

1. In a vertical rod exit device for securing an outwardly opening door in closed position and having at least one latch, means for mounting the one latch on the inner face of the door, a vertically extending latch operating rod having one end portion operably connected to said one latch, a latch rod shift mechanism operably connected to the other end portion of the latch operating rod, means for mounting said shifting mechanism on the inner face of the door, a rotary outside latch operator for attachment to the outer face of the door and journalled for angular movement about a horizontal axis normal to the faces of the door, the vertical extending latch operating rod being horizontally offset from said horizonal axis and in the direction of the free side edge of the door, the rod shifting mechanism being operable to shift the latch operating rod in one vertical direction and to a latch releasing position in response to operation of the rotary outside latch operator, and an inside latch actuator operably associated with the latch shifting mechanism and at all times operable independently of the outside latch operator to shift the latch operating rod in the one direction and to a latch releasing position in response to pressure applied in a door opening direction to the inside latch actuator, the improvement wherein said rod shifting mechanism includes a frame assembly comprising said mounting means, a rod connector, means supporting said rod connector for limited reciprocal vertical movement on and relative to said frame assembly, means for connecting said latch operating rod to said rod connector, actuating means for moving said rod and said rod connector in said one vertical direction in response to pressure applied in a door opening direction to said inside latch actuator, a key plate, means supporting said key plate for vertical movement on said frame assembly, said key plate being engageable with said rod connector for moving said rod connector and said rod in said one vertical direction and to a latch releasing position in response to angular movement of said outside latch operator and independent of the movement of said actuating means, and a key center operably engaged with said key plate and said outside operator and journalled on said frame assembly for coaxial angular movement with said outside operator, and wherein said rod connector overlies an associated marginal portion of said key plate and said key center underlies another marginal portion of said key plate.

2. In a vertical rod exit device as set forth in claim 1 the further improvement wherein said actuating means comprises a bell crank having one leg engaged with said one of the members comprising said rod and said rod connector and having another leg disposed in the path of said inside latch actuator.

3. In a vertical rod exit device as set forth in claim 2 the further improvement wherein said inside latch actuator comprises a push bar for mounting on the inner face of the door to extend transversely thereof and supported by a parallelogram linkage for movement generally toward and away from the inner face.

4. In a vertical rod exit device for securing a door in closed position and including at least one latch having latching and releasing positions, a latch operating rod having one end portion operably connected to said one latch, latch rod shifting means operably connected to the other end portion of the latch operating rod for axially shifting said operating rod in one direction from one position corresponding to a latching condition to another position corresponding to a releasing condition of the one latch, angularly movably outside operating means for operating said rod shifting means to move the latch operating rod from the one to the other position, and inside operating means at all times operable independently of the outside operating means for operating said rod shifting means to move the latch operation rod from the one to the other position, the improvement wherein said rod shifting means comprises frame means for attachment to a door, a rod connector, means supporting said rod connector on said frame means for reciprocal movement in said one and an opposite direction relative to said frame means, means connecting said latch operating rod to said rod connector, a key plate engageable with said rod connector, means supporting said key plate for reciprocal movement in said one and said opposite direction relative to said frame means, and a key center journalled on said frame means in underlying relation to said key plate for angular movement with said outside operating means and operably engaged with said key plate for moving said key plate to move said rod connector from said one to said other position in response to angular movement of said outside operating means.

5. In a vertical rod exit device as set forth in either claim 1 or claim 4 the further improvement wherein said key plate comprises said means supporting said rod connector.

6. In a vertical rod exit device as set forth in claim 5 the further improvement wherein said key plate includes a connecting pin extending through a vertically disposed slot in said rod connector and comprising said means supporting said rod connector.

7. In a vertical rod exit device as set forth in either claim 1 or claim 4 the further improvement wherein said frame means includes a back plate and said means supporting said key plate includes a retaining pin projecting from one of the plate comprising said back plate and said key plate and extending through a slot in the other of said plates.

8. In a vertical rod exit device as set forth in claim 7 the further improvement wherein said means supporting said rod connector comprises another retaining pin projecting from one of the members comprising said key plate and said rod connector and extending through a slot in the other of said members.

9. In a vertical rod exit device as set forth in claim 4 the further improvement wherein the axis of said angularly movable outside operating means is transversely offset from the axis of said rod.

10. In a vertical rod exit device as set forth in claim 4 the further improvement comprising biasing means for urging said key plate toward engagement with said key center.

11. In a vertical rod exit deivce as set forth in claim 10 the further improvement wherein said biasing means comprises a spring acting between said key plate and said frame means.

12. In a vertical rod exit device as set forth in claim 4 the further improvement wherein said rod shifting means includes actuating means for moving said rod connector and said rod from said one to said other position in response to operation of said inside operating means.

13. In a vertical rod exit device as set forth in claim 12 the further improvement wherein said actuating means comprises a bell crank having one end engaged with one of the members comprising said rod and said rod connector and having another leg engaged by said inside operating means.

14. In a vertical rod exit device as set forth in claim 13 the further improvement wherein said inside operating means comprises a push bar.

15. In a vertical rod exit device as set forth in claim 14 wherein said outside operating means comprises a knob assembly.

16. In a vertical rod exit device as set forth in claim 14 the further improvement wherein said outside operating means comprises a lock cylinder.

* * * * *